US012583698B2

(12) United States Patent
Iwata et al.

(10) Patent No.: US 12,583,698 B2
(45) Date of Patent: Mar. 24, 2026

(54) SHEET CONVEYING APPARATUS

(71) Applicants: Toshiyuki Iwata, Tokyo (JP); Tsukasa Kondo, Minamikoma-gun (JP); Tetsuya Kawasaki, Minamikoma-gun (JP); Yuuki Kubota, Minamikoma-gun (JP)

(72) Inventors: Toshiyuki Iwata, Tokyo (JP); Tsukasa Kondo, Minamikoma-gun (JP); Tetsuya Kawasaki, Minamikoma-gun (JP); Yuuki Kubota, Minamikoma-gun (JP)

(73) Assignee: CANON FINETECH NISCA INC., Misato (JP)

( * ) Notice: Subject to any disclaimer, the term of this patent is extended or adjusted under 35 U.S.C. 154(b) by 453 days.

(21) Appl. No.: 17/360,624

(22) Filed: Jun. 28, 2021

(65) Prior Publication Data

US 2021/0403263 A1 Dec. 30, 2021

(30) Foreign Application Priority Data

Jun. 30, 2020 (JP) ..... 2020-112401

(51) Int. Cl.
*B65H 9/06* (2006.01)
*B65H 5/02* (2006.01)

(52) U.S. Cl.
CPC ..... *B65H 9/06* (2013.01); *B65H 5/025* (2013.01)

(58) Field of Classification Search
CPC . B65H 9/06; B65H 5/025; B65H 9/00; B65H 9/101
See application file for complete search history.

(56) References Cited

U.S. PATENT DOCUMENTS 4,905,979 A * 3/1990 Limbach ..... B65H 33/08 271/189
5,540,370 A * 7/1996 Ring ..... B65H 29/60 271/253
5,937,260 A 8/1999 Taninaka et al.
(Continued)

FOREIGN PATENT DOCUMENTS

JP S5446538 U 3/1979
JP H04323149 A 11/1992
(Continued)

OTHER PUBLICATIONS

Machine translation of JP 2014-9071. (Year: 2014).*
Japan Patent Office, Notice of Reasons for Refusal for Japanese Application No. 2020-112401 mailed on Oct. 8, 2024; 9 pp.

*Primary Examiner* — Thomas A Morrison
(74) *Attorney, Agent, or Firm* — HAUPTMAN HAM, LLP

(57) ABSTRACT

In order to provide a configuration capable of stably performing conveyance of sheets, a pair of regulation guides are capable of guiding opposite end edges in the sheet width direction Y of a sheet S conveyed by a conveyance belt and spheres, while being nipped. Further, the pair of regulation guides are capable of shifting to guide positions for guiding the opposite end edges of the sheet and retract positions retracted from the opposite end edges of the sheet more than the guide positions. In shifting the pair of regulation guides from the retract positions to the guide positions, a guide shift section causes the one of regulation guides to arrive at the guide position after the other of regulation guides arrives at the guide position.

6 Claims, 10 Drawing Sheets

(56) References Cited

U.S. PATENT DOCUMENTS

| | | | | |
|---|---|---|---|---|
| 8,998,198 | B2 * | 4/2015 | Yamajo | B65H 31/24 271/220 |
| 2007/0138731 | A1 * | 6/2007 | Terao | B65H 37/04 270/58.12 |
| 2008/0187383 | A1 * | 8/2008 | Yamamoto | G03G 15/6538 399/407 |
| 2010/0219576 | A1 * | 9/2010 | Yamamoto | B65H 9/101 270/58.08 |
| 2011/0266742 | A1 * | 11/2011 | Sato | B65H 9/006 271/265.01 |
| 2020/0399085 | A1 * | 12/2020 | Furumido | B65H 31/3081 |

FOREIGN PATENT DOCUMENTS

| | | | |
|---|---|---|---|
| JP | H10167526 | A | 6/1998 |
| JP | 2006047675 | A | 2/2006 |
| JP | 2007-217096 | A | 8/2007 |
| JP | 2011230909 | A | 11/2011 |
| JP | 2014009071 | A | 1/2014 |
| JP | 2017075049 | A | 4/2017 |

* cited by examiner

SHEET CONVEYING APPARATUS

TECHNICAL FIELD

The present invention relates to a sheet conveying apparatus for conveying sheets.

BACKGROUND ART

In a sheet conveying apparatus for conveying sheets, there is the risk that misregistration of a sheet occurs due to various factors during conveyance of the sheet. Then, while the misregistration occurs, for example, in the case of conveying to an image forming apparatus for forming an image on the sheet, the inconvenience occurs such that the image is displaced with respect to the sheet. Therefore, there is a known sheet conveying apparatus for correcting misregistration of a sheet under conveyance (e.g., Japanese Unexamined Patent Publication No. 2007-217096).

In Japanese Unexamined Patent Publication No. 2007-217096 is disclosed a configuration including a fixed reference guide provided on one side in a width direction crossing a sheet conveyance direction, a conveyance belt provided obliquely with respect to the reference guide, and spheres. In the case of the sheet conveying apparatus described in Japanese Unexamined Patent Publication No. 2007-217096, the conveyance belt and spheres convey the sheet, while nipping, and an end edge of the sheet in the width direction is struck by the reference guide. Then, side registration (misregistration of end edges in the sheet width direction) and side skew (skew of the end edge of the sheet in the width direction with respect to the sheet conveyance direction) is concurrently corrected.

DISCLOSURE OF INVENTION

Problems to be Solved by the Invention

In the case of the sheet conveying apparatus described in Japanese Unexamined Patent Publication No. 2007-217096, while the sheet is conveyed by the conveyance belt provided obliquely, the end edge of the sheet in the width direction is struck by the reference guide. Therefore, it is necessary to convey the sheet until the sheet is struck by the reference guide, and in order to reserve a length to convey the sheet, there is the risk that the apparatus is increased in size. Then, in order to correct misregistration of the sheet in the width direction, while suppressing upsizing of the apparatus, such a configuration is considered that a pair of regulation guides are provided on opposite sides of the sheet in the width direction. In the case of this configuration, a pair of regulation guides are shifted from retract positions to guide positions to guide opposite end edges of the sheet in the width direction in the guide positions, and thereby correct misregistration of the sheet in the width direction.

In the case of the configuration for thus shifting the regulation guides to guide the end edges of the sheet in the width direction, when the regulation guide is shifted to the guide position and is halted, the regulation guide vibrates. Therefore, when a pair of regulation guides are halted in the guide positions at the same time, the pair of regulation guides vibrate at the same time, the amplitude is thereby increased, and there is the risk that the end edges of the sheet in the width direction are pressed in by the pair of regulation guides. In this case, a load is imposed on the sheet, and there is the risk that conveyance of the sheet is affected.

It is an object of the present invention to provide a configuration capable of stably performing conveyance of sheets.

Means for Solving the Problem

In the present invention, a sheet conveying apparatus which receives and conveys a sheet conveyed by a conveyance member for conveying the sheet in a predetermined conveyance direction is provided with an endless conveyance belt disposed on the downstream side of the conveyance member in the conveyance direction to include a conveyance face extended in the conveyance direction and to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a first regulation guide disposed on one side of the conveyance belt with respect to a sheet width direction crossing the conveyance direction to be able to guide an end edge on one side in the sheet width direction of the sheet conveyed by the conveyance belt and the spheres, while being nipped, a second regulation guide disposed on the other side of the conveyance belt with respect to the sheet width direction crossing the conveyance direction to be able to guide an end edge on the other side in the sheet width direction of the sheet conveyed by the conveyance belt and the spheres, while being nipped, and a guide shift section capable of shifting the first regulation guide and the second regulation guide to guide positions for guiding end edges of the sheet in the sheet width direction and retract positions retracted from the end edges of the sheet in the sheet width direction more than the guide positions, where in shifting the first regulation guide and the second regulation guide from the retract positions to the guide positions, the guide shift section causes the second regulation guide to arrive at the guide position after the first regulation guide arrives at the guide position.

Advantageous Effect of the Invention

According to the present invention, it is possible to stably perform conveyance of sheets.

MODE FOR CARRYING OUT THE INVENTION

Embodiment 1

Embodiment 1 will be described with reference to FIGS. 1 to 9. First, an image forming system of this Embodiment will be described with reference to FIG. 1.

[Image Forming System]

Figure 1:
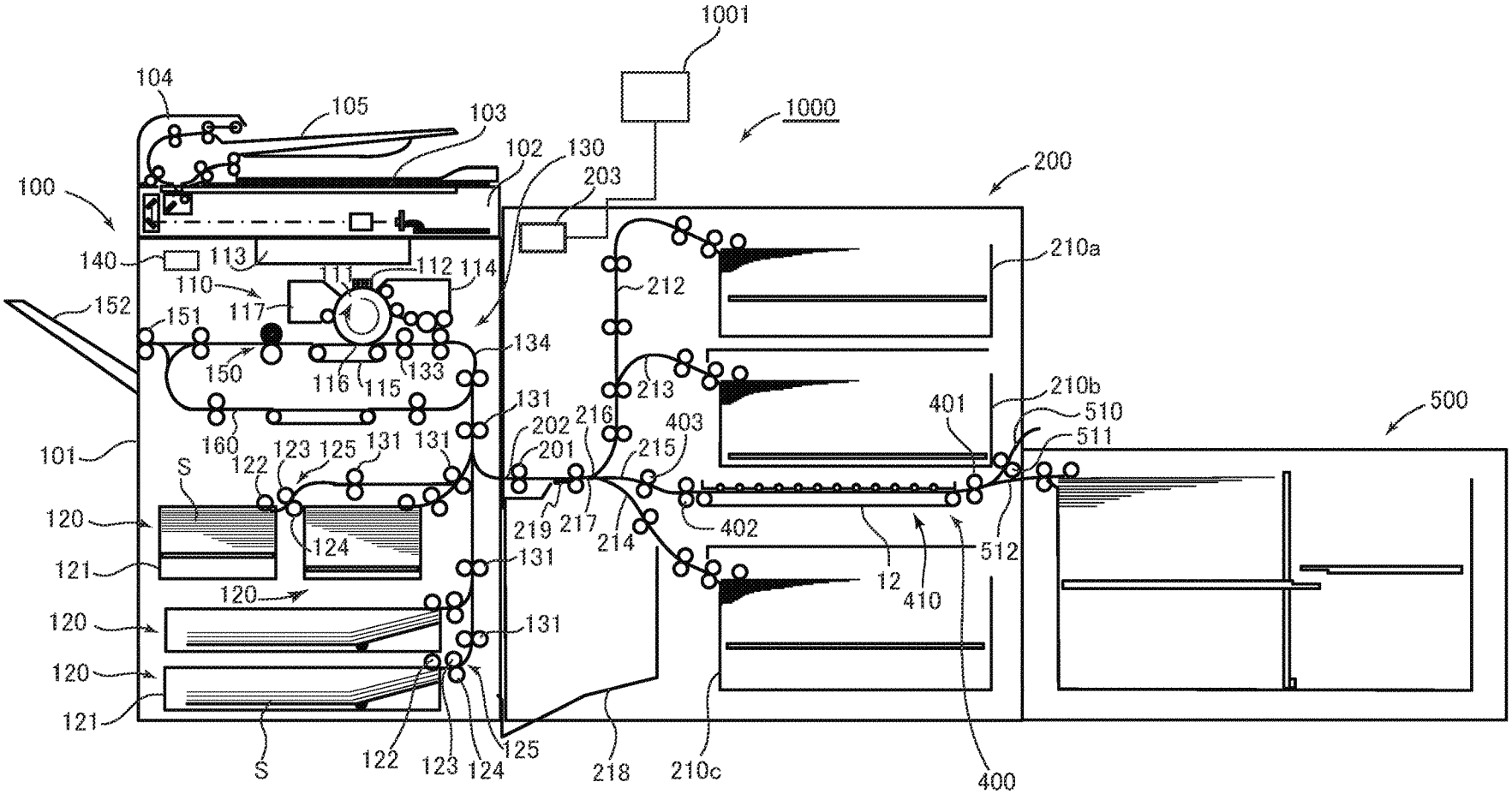
FIG. 1 is a schematic configuration cross-sectional view of an image forming system according to Embodiment 1.

FIG. 1 is a cross-sectional view schematically showing one example of an image forming system provided with a multi-stage feed apparatus and image forming apparatus according to this Embodiment. In the following description, as the image forming apparatus including an image forming section, a laser printer system (hereinafter, simply called a printer) using an electrophotographic scheme will be described as an example. In addition, as well as the printer, the image forming apparatus constituting the image forming system may be a copier, facsimile, composite machine and the like. Further, the image forming apparatus is not limited to the electrophotographic scheme, and may be a configuration of another scheme such as an ink jet scheme.

The image forming system 1000 of this Embodiment includes an image forming apparatus 100, a multi-stage feed apparatus 200 connected to the image forming apparatus 100 as a sheet feed apparatus, and a feed deck 500. As described later in detail, the multi-stage feed apparatus 200 includes a plurality of storage chambers each capable of storing a plurality of sheets, and is capable of feeding a sheet from each of the storage chambers to the image forming apparatus 100. Further, the feed deck 500 also includes a storage chamber capable of storing a plurality of sheets, and is disposed on the upstream side of the multi-stage feed apparatus 200 with respect to a sheet conveyance direction. Further, the sheet fed from the feed deck 500 is conveyed to the image forming apparatus 100 via a relay conveying apparatus 400 provided in the multi-stage feed apparatus 200. In addition, as sheets, there are papers such as normal paper, thin paper and thick paper, plastic sheets and the like.

The image forming apparatus 100 forms a toner image (image) on a sheet corresponding to an image signal from a document reading apparatus 102 connected to an image forming apparatus main body 101, or a host apparatus such as a personal computer connected to the image forming apparatus main body 101 to be communicable and the like. In the case of this Embodiment, the document reading apparatus 102 is disposed on the image forming apparatus main body 101.

In reading a document, the document reading apparatus 102 irradiates the document placed on platen glass 103 with light by a scanning optical system light source, while inputting reflected light to a CCD, and thereby reads a document image. Further, the document reading apparatus 102 is provided with an automatic document feeder (ADF) 104, and is also able to read a document image by automatically conveying a document placed on a tray 105 to a reading section of the document reading apparatus 102 by the ADF 104. Then, the read document image is converted into an electric signal, and is transmitted to a laser scanner 113 of an image forming section 110 described later. In addition, there is also the case where image data transmitted from the personal computer or the like as described above is input to the laser scanner 113.

The image forming apparatus 100 is provided with the image forming section 110, a plurality of sheet feed apparatuses 120, sheet conveying apparatus 130 and the like. In the image forming apparatus 100, a control section 140 controls each section. The control section 140 has a CPU (Central Processing Unit), ROM (Read Only Memory), and RAM (Random Access Memory). The CPU reads programs that correspond to control procedures stored in the ROM to control each section. Further, in the RAM is stored operation data and input data, and the CPU performs control by referring to the data stored in the RAM, based on the programs and the like described previously.

Each of the plurality of sheet feed apparatuses 120 is provided with a cassette 121 for storing sheets S, a pick-up roller 122, and a separation conveyance roller pair 125 comprised of a feed roller 123 and retard roller 124. The sheets S stored inside the cassette 121 are separated and fed on a sheet-by-sheet basis, by the pick-up roller 122 for performing up-and-down operation and rotating at predetermined timing, and the separation conveyance roller pair 125.

The sheet conveying apparatus 130 is provided with a conveyance roller pair 131, and register roller pair 133. The sheet S fed from the sheet feed apparatus 120 is passed through a sheet conveyance path 134 by the conveyance roller pair 131, and then, is guided to the register roller pair 133. Subsequently, the sheet S is sent to the image forming section 110 at predetermined timing by the register roller pair 133.

In addition, the sheet, which is conveyed from the multi-stage feed apparatus 200 described later and the feed deck 500 via a conveyance roller pair 201, is conveyed into the image forming apparatus 100 via a connection path 202 with the image forming apparatus 100. Then, the sheet, which is conveyed from the multi-stage feed apparatus 200 and the feed deck 500 into the image forming apparatus 100, is sent into the image forming section 110 at predetermined timing via the register roller pair 133, as the sheet conveyed from the sheet feed apparatus 120 inside the image forming apparatus 100.

The image forming section 110 is provided with a photosensitive drum 111, charger 112, laser scanner 113, developing device 114, transfer apparatus 115, cleaner 117 and the like. At the time of image formation, the photosensitive drum 111 is driven to rotate in the arrow direction shown in the figure, and first, a surface of the photosensitive drum 111 is uniformly charged by the charger 112. Then, the charged photosensitive drum 111 is irradiated with laser light from the laser scanner 113 emitted corresponding to the image signal, and an electrostatic latent image is thereby formed on the photosensitive drum 111. Further, the electrostatic latent image thus formed on the photosensitive drum 111 is subsequently developed as a toner image by the developing device 114.

Subsequently, the toner image on the photosensitive drum 111 is transferred to the sheet S by the transfer apparatus 115 in a transfer section 116. Further, the sheet S with the toner image thus transferred is conveyed to a fuser apparatus 150 to fuse the toner image, and then, is discharged to a discharge tray 152 outside the apparatus by a discharge roller 151.

In the case where a toner image is formed on the backside of the sheet S, the sheet S discharged from the fuser apparatus 150 is conveyed to a reverse conveyance path 160. Then, in a state in which the side is reversed by the reverse conveyance path 160, the sheet S is conveyed again to the transfer section 116 of the image forming section 110. The sheet S with the toner image transferred to the backside is conveyed to the fuser apparatus 150, and after fusing the toner image, is discharged to the discharge tray 152 by the discharge roller 151. In addition, after transferring, transfer residual toner left on the photosensitive drum 111 is removed by the cleaner 117.

[Multi-Stage Feed Apparatus]

Successively, the outline of the multi-stage feed apparatus 200 will be described with reference to FIG. 1. The multi-stage feed apparatus 200 is provided with a plurality of storage chambers 210*a* to 210*c*, relay conveying apparatus 400 and the like. In this Embodiment, three storage chambers 210*a* to 210*c* are arranged vertically in three stages, and the relay conveying apparatus 400 is disposed between the lowermost storage chamber 210*c* and the second uppermost storage chamber 210*b*.

A sheet fed from the uppermost storage chamber 210*a* is conveyed to a conveyance path 212, a sheet fed from the second uppermost storage chamber 210*b* is conveyed to a conveyance path 213, and a sheet fed from the lowermost storage chamber 210*c* is conveyed to a conveyance path 214. Further, a sheet conveyed from the relay conveying apparatus 400 is conveyed to a conveyance path 215. The conveyance path 213 merges with the conveyance path 212 at some midpoint. Further, the conveyance paths 212, 214 and 215 merge at a confluence 216, and the sheet is conveyed to the conveyance roller pair 201 through a conveyance path 217, and is conveyed to the image forming apparatus 100 via the connection path 202.

Further, a multi feed detecting sensor for detecting multi feed of sheets is disposed in each of the conveyance path 212 merged with the conveyance path 213, the relay conveying apparatus 400 and the conveyance path 214. Then, sheets with multi feed detected by the multi feed detecting sensor are conveyed to the conveyance path 217. Below the conveyance path 217 is disposed a multi feed sheet storage section (escape tray) 218 for storing sheets with multi feed detected. The sheets with multi feed detected are conveyed to the conveyance path 217, and are conveyed to the multi feed sheet storage section, by switching between conveyance paths by a switch member 219 provided in the conveyance path 217.

Further, in the multi-stage feed apparatus 200, a control section 203 controls each section. The control section 203 has a CPU (Central Processing Unit), ROM (Read Only Memory), and RAM (Random Access Memory). Further, the control section 203 is capable of communicating with the control section 140 of the image forming apparatus 100, and by communicating with the control section 140, controls feed timing of the sheet and the like.

The sheet fed from the feed deck 500 on the upstream side passes through a conveyance path 512, and is conveyed to the relay conveying apparatus 400. Further, the multi-stage feed apparatus 200 enables a sheet manually inserted to be also fed. The manually fed sheet is conveyed to a conveyance path 510 merging with the conveyance path 512, and is conveyed to the relay conveying apparatus 400 via the conveyance path 512 by a conveyance roller pair 511.

Although details will be described next, the relay conveying apparatus 400 is provided with a misregistration correcting section 410 provided with a conveyance belt 12 and the like, a conveyance roller pair 401 on the upstream side of the misregistration correcting section 410 in the sheet conveyance direction, a conveyance roller pair 402 on the downstream side of the misregistration correcting section 410 in the sheet conveyance direction, and the like. The sheet conveyed in the conveyance path 512 is fed to the misregistration correcting section 410 by the conveyance roller pair 401. After correcting side registration (misregistration of end edges in the sheet width direction) and side skew (skew of the end edge of the sheet in the width direction with respect to the sheet conveyance direction) in the misregistration correcting section 410, the sheet is delivered to the conveyance roller pair 402 on the downstream side. Then, the sheet is conveyed to the conveyance path 215 by the conveyance roller pairs 402, 403. Thus, the relay conveying apparatus 400 corrects misregistration and so on of the sheet conveyed from the feed deck 500 and the like on the upstream side, and delivers to the image forming apparatus 100 on the downstream side.

[Relay Conveying Apparatus]

The relay conveying apparatus 400 as a sheet conveying apparatus will be described next. First, a schematic configuration of the relay conveying apparatus 400 will be described with reference to FIGS. 2 to 5. The relay conveying apparatus 400 includes the conveyance roller pair 401 on the upstream side, the conveyance roller pair 402 on the downstream side, the misregistration correcting section 410 described above and the like, and conveys the sheet in a conveyance direction X. The misregistration correcting section 410 has the conveyance belt 12, a plurality of spheres 20, a pair of regulation guides 14A, 14B, guide shift section 420 and the like.

The conveyance belt 12 is disposed downstream (downstream in the conveyance direction) in the conveyance direction X from the conveyance roller pair 401 as a conveyance member for conveying the sheet. The conveyance belt 12 is an endless belt looped between pulleys 11A, 11B, and has a conveyance face 12A provided to extend along the conveyance direction X. To the pulley 11A on one side is connected a motor M1 as a drive source, and the conveyance belt 12 rotates by drive of the motor M1. Such a conveyance belt 12 conveys, in the direction X, the sheet delivered from the conveyance roller pair 401 on the upstream side in the conveyance direction X to the conveyance face 12A.

Figure 2:
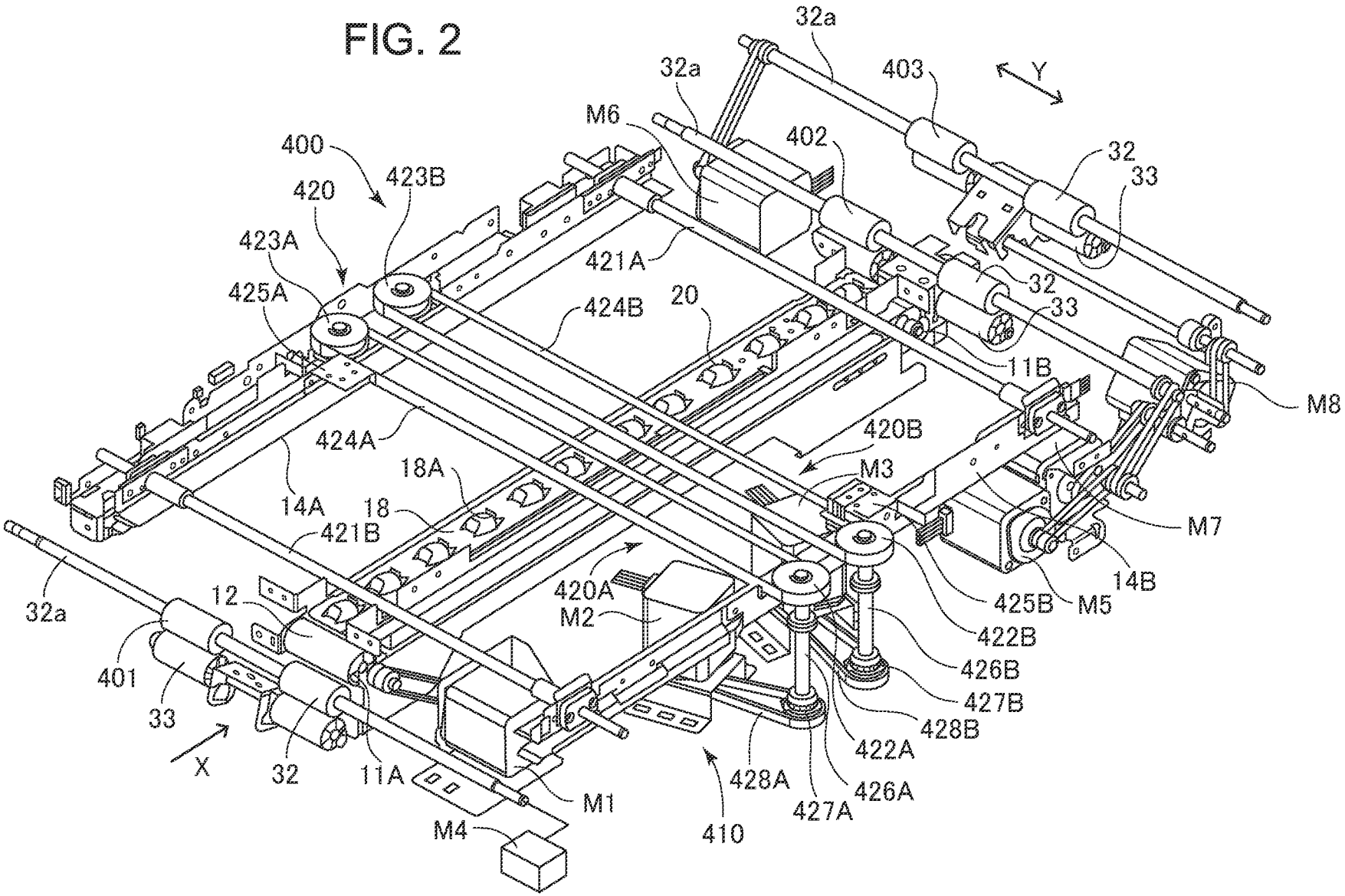
FIG. 2 is a perspective view of a relay conveying apparatus according to Embodiment 1.
Figure 3:
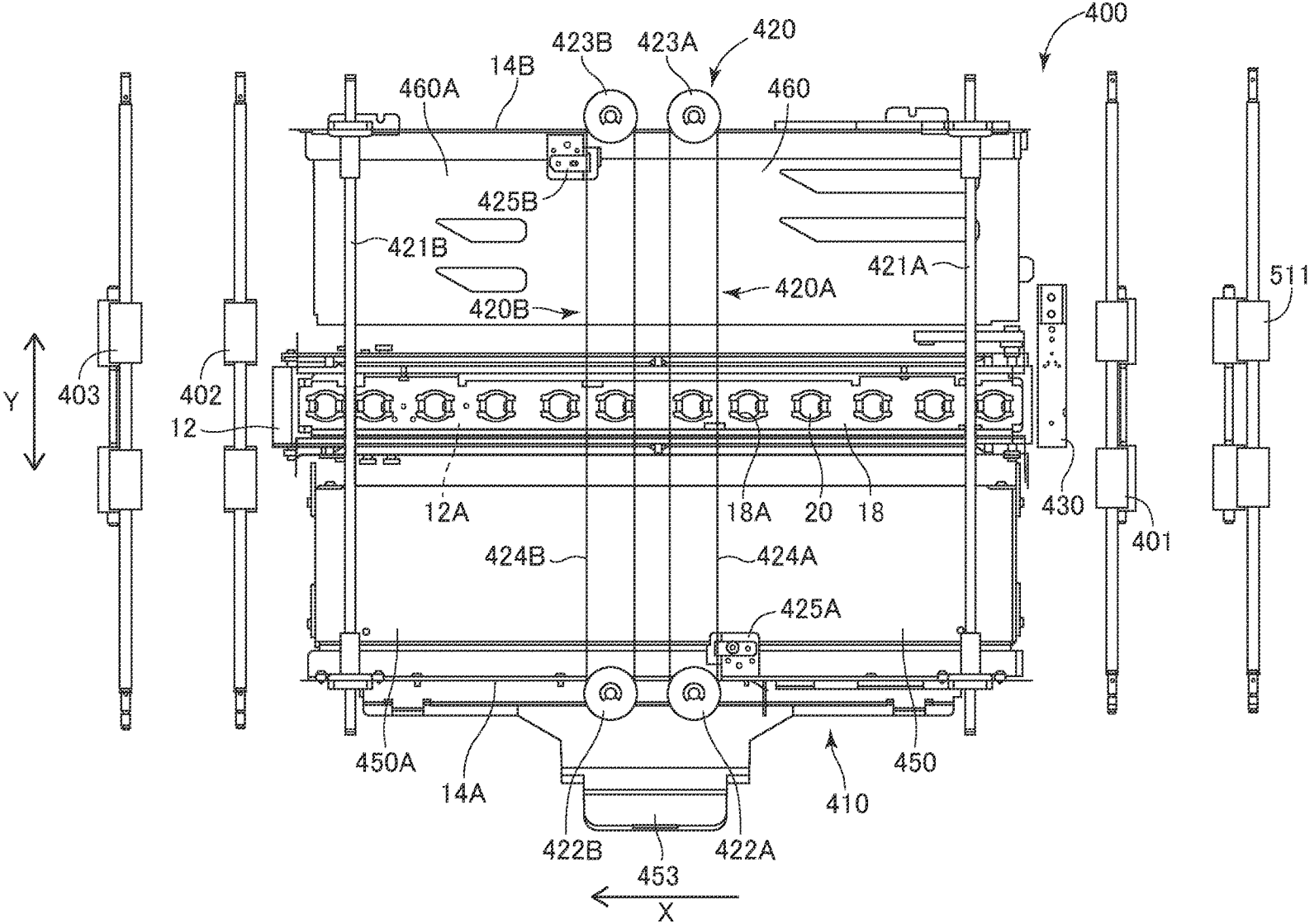
FIG. 3 is a plan view of the relay conveying apparatus according to Embodiment 1.

A plurality of spheres 20 is disposed along the conveyance direction X in positions opposed to the conveyance face 12A of the conveyance belt 12. In this Embodiment, the plurality of spheres 20 is disposed above the conveyance belt 12. The plurality of spheres 20 is capable of rotating in any direction, while nipping the sheet with the conveyance face 12A. Therefore, each of the plurality of spheres 20 is held in a hold plate 18 provided above the conveyance belt 12 rotatably in any direction. In other words, as shown in FIGS. 2 and 3, the hold plate 18 is a long plate disposed along the conveyance direction X in a position spaced a predetermined distance apart from the conveyance face 12A above the conveyance belt 12, and has a plurality of hold holes 18A at a distance from one another in the conveyance direction X. Then, the hold holes 18A hold the spheres 20 rotatably, respectively.

Figure 4:
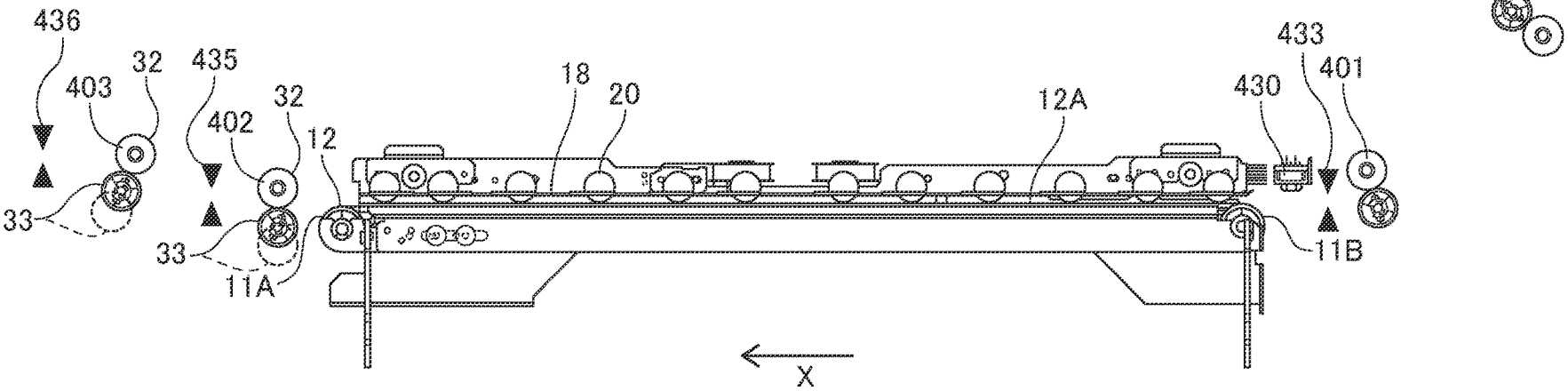
FIG. 4 is a side elevational view of the relay conveying apparatus according to Embodiment 1.

As shown in FIG. 4, the sphere 20 is exposed from the hold hole 18A, is placed on the conveyance face 12A of the conveyance belt 12, and is made rotatable in any direction. Each of the spheres 20 is brought into contact with the conveyance face 12A under its own weight. In addition, the number of spheres 20 may be set corresponding to a pressing force required for the sheet conveyed on the conveyance belt 12. Further, since the sheet is conveyed, while slipping on the conveyance belt 12 as described later, the sphere 20 is preferably comprised of a material such as glass and plastic with a relatively low coefficient of friction. In addition, this Embodiment describes the configuration where the plurality of spheres 20 is arranged in a single line along the conveyance direction X, and a plurality of spheres 20 may be arranged and disposed in each of a plurality of lines such as two lines in the conveyance direction X.

A pair of regulation guides 14A, 14B are disposed on opposite sides of the conveyance belt 12, with respect to the sheet width direction Y (in this Embodiment, direction orthogonal to the conveyance direction) crossing the conveyance direction X. Then, the pair of regulation guides 14A, 14B are capable of guiding opposite end edges (opposite end edges in the sheet width direction) in the sheet width direction Y of the sheet that is conveyed by the conveyance belt 12 and the sphere 20, while being nipped. In other words, the regulation guide 14A, which is disposed on one side (front side of the apparatus) with respect to the sheet width direction Y as a first regulation guide, is capable of guiding the end edge on one side in the sheet width direction of the sheet that is conveyed by the conveyance belt 12 and the sphere 20, while being nipped. Further, the regulation guide 14B, which is disposed on the other side (rear side of the apparatus) with respect to the sheet width direction Y as a second regulation guide, is capable of guiding the end edge on the other side in the sheet width direction of the sheet that is conveyed by the conveyance belt 12 and the sphere 20, while being nipped. In addition, the one side (front side) in the sheet width direction Y is the side to operate the image forming system 1000.

Figure 5:
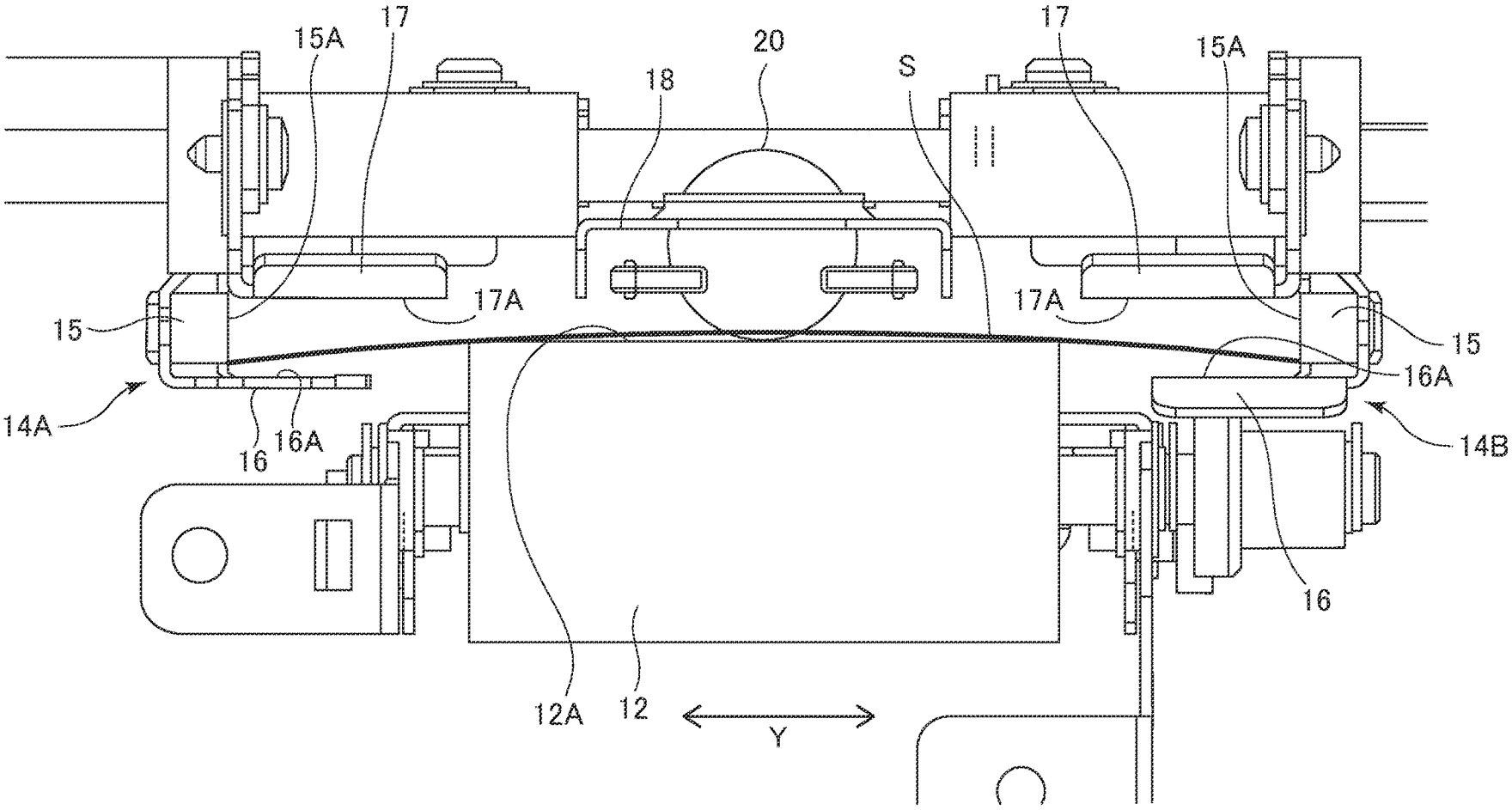
FIG. 5 is a cross-sectional view of the relay conveying apparatus according to Embodiment 1.

As shown in FIG. 5, each of the pair of regulation guides 14A, 14B includes a side plate portion 15, lower plate portion 16, and upper plate portion 17, and enables the end portion of the sheet S conveyed by the conveyance belt 12 to enter a space surrounded by the plate portions 15, 16 and 17. The pair of regulation guides 14A, 14B are supported by support shafts 421A, 421B (see FIG. 3) to be able to shift to guide positions and retract positions by the guide shift section 420 described later. Each of the support shafts 421A, 421B is disposed substantially parallel with the sheet width direction Y, and supports end portion sides of the pair of regulation guides 14A, 14B in the conveyance direction X. The pair of regulation guides 14A, 14B are capable of shifting in the sheet width direction Y along the support shafts 421A, 421B.

The side plate portion 15 has a guide face 15A opposed to the end edge in the sheet width direction Y of the sheet S that is conveyed by the conveyance belt 12 and the sphere 20, while being nipped, in the guide position. The guide face 15A is disposed parallel with the conveyance direction X. Further, the guide face 15A is a face orthogonal to each of the conveyance direction X and the sheet width direction Y, and in this Embodiment, is a face along the substantially vertical direction.

The lower plate portion 16 has a support face 16A which is disposed to be orthogonal to the side plate portion 15, and supports the end edge in the sheet width direction Y of the sheet S that is conveyed by the conveyance belt 12 and the sphere 20, while being nipped, in the guide position. The support face 16A is provided to extend substantially in the horizontal direction from a lower end portion of the guide face 15A in the vertical direction. Further, the support face 16A is positioned below the conveyance face 12A of the conveyance belt 12 in the vertical direction.

Herein, the case is considered where the support face 16A and conveyance face 12A are the same height, or the support face 16A is positioned above the conveyance face 12A in the vertical direction. In this case, when a sheet S such as thick paper with high stiffness is conveyed to between the conveyance belt 12 and the sphere 20 in a downward curled state (state in which the opposite end edges in the width direction Y are lower than the center) as shown in FIG. 5, the opposite end edges of the sheet S in the width direction Y are supported by the support faces 16A. At this point, the center portion of the sheet S in the width direction Y is in a state of being raised (in a bridged state), and pushes the sphere 20 up. As a result, the conveyance belt 12 and the sphere 20 are in a separate state, and there is the risk that the conveyance force of the conveyance belt 12 is not transferred to the sheet S, and that a conveyance failure occurs. Therefore, in this Embodiment, the support face 16A is disposed below the conveyance face 12A of the conveyance belt 12 in the vertical direction.

The upper plate portion 17 has an opposed face 17A disposed opposite the support face 16A. The opposed face 17A is positioned above the end edge in the sheet width direction Y of the sheet S that is conveyed by the conveyance belt 12 and the sphere 20, while being nipped, in the guide position. Further, the opposed face 17A is formed substantially parallel with the support face 16A.

As shown in FIGS. 2 and 3, the guide shift section 420 as a guide shift section has a first shift section 420A for shifting the regulation guide 14A on one side in the pair of regulation guides 14A, 14B, and a second shift section 420B for shifting the regulation guide 14B on the other side. Further, the guide shift section 420 has a motor M2 for generating a driving force to shift the regulation guide 14A, and a motor M3 for generating a driving force to shift the regulation guide 14B on the other side.

The first shift section 420A has a pair of pulleys 422A, 423A, an endless belt 424A looped between both of the pulleys 422A, 423A, and a connection portion 425A for connecting between the belt 424A and the regulation guide 14A. Similarly, the second shift section 420B has a pair of pulleys 422B, 423B, an endless belt 424B looped between both of the pulleys 422B, 423B, and a connection portion 425B for connecting between the belt 424B and the regulation guide 14B on the other side.

Further, as shown in FIG. 2, the first shift section 420A is driven by the motor M2 as a drive source, and the second shift section 420B is driven by the motor M3 as a drive source. In other words, in the case of this Embodiment, different motors are used as drive sources for shifting the pair of regulation guides 14A, 14B, respectively, and the pair of regulation guides 14A, 14B are capable of shifting independently of each other. Therefore, the pulley 422A of the first shift section 420A is coupled to a pulley 427A via a coupling shaft 426A, and a belt 428A is looped between the pulley 427A and a pulley driven to rotate by the motor M2. Then, rotation drive of the motor M2 is transferred to the belt 424A via the belt 428A, pulley 427A, coupling shaft 426A, and pulley 422A. As described above, since the belt 424A is connected to the regulation guide 14A via the connection portion 425A, by drive of the motor M2, the regulation guide 14A shifts in the sheet width direction Y along the support shafts 421A, 421B.

Similarly, the pulley 422B of the second shift section 420B is coupled to a pulley 427B via a coupling shaft 426B, and a belt 428B is looped between the pulley 427B and a pulley driven to rotate by the motor M3. Then, rotation drive of the motor M3 is transferred to the belt 424B via the belt 428B, pulley 427B, coupling shaft 426B, and pulley 422B. As described above, since the belt 424B is connected to the regulation guide 14B on the other side via the connection portion 425B, by drive of the motor M3, the regulation guide 14B on the other side shifts in the sheet width direction Y along the support shafts 421A, 421B.

By thus driving the motors M2, M3, the regulation guides 14A, 14B are shifted to the guide positions and retract positions, respectively. In the case of this Embodiment, each of the motors M2, M3 is a pulse motor (stepping motor), and a position of each of the regulation guides 14A, 14B is controlled by the number of pulses sent to the motor, respectively. Further, each of the regulation guides 14A, 14B has a home position, and a sensor for detecting each of the regulation guides 14A, 14B is provided in the home position, respectively. Therefore, positions of the regulation guides 14A, 14B are detected in home positions, and subsequently, using the number of pulses sent to the motor, each of the regulation guides 14A, 14B is shifted to the guide position and the retract position.

In addition, in the case of this Embodiment, the motor M1 for driving the conveyance belt 12 described above, the motors M2, M3 for shifting the regulation guides 14A, 14B, and motors M5, M7, M8 described later are disposed on the other-side regulation guide 14B side. Particularly, with respect to the conveyance direction X, motors within a conveyance range of the sheet of the misregistration correcting section 410 are preferably disposed on the rear side of the conveyance belt 12 (the other-side regulation guide 14B side). This is because the case of this Embodiment is configured to remove a jammed sheet from the front side (one-side regulation guide 14A side).

Further, in the case of this Embodiment, as shown in FIGS. 3 and 4, a multi feed detecting sensor 430 for detecting multi feed of sheets is disposed between the conveyance roller pair 401 on the upstream side and the conveyance belt 12. For example, the multi feed detecting sensor 430 is a sensor for detecting that two or more sheets are stacked and conveyed by an ultrasonic wave. In the case of detecting multi feed of sheets by the multi feed detecting sensor 430, the control section 203 (FIG. 1) of the multi-stage feed apparatus 200 conveys the multi-fed sheets to the multi feed sheet storage section 218 via the relay conveying apparatus 400, and the conveyance paths 215, 217.

Further, as shown in FIG. 4, the relay conveying apparatus 400 of this Embodiment has a plurality of sheet detecting sensors 433, 435, 436 to detect a jam of a sheet. In addition, the jam of a sheet is that the sheet remains in the conveyance path by jamming or the like. The sheet detecting sensor 433 detects a sheet conveyed by the conveyance roller pair 401 upstream of the conveyance belt 12. The sheet detecting sensor 435 is disposed between the conveyance roller pair 402 and the conveyance roller pair 403 to detect the sheet conveyed by the conveyance roller pair 402. The sheet detecting sensor 436 is disposed downstream of the conveyance roller pair 403 to detect the sheet conveyed by the conveyance roller pair 403.

Based on detection signals of various sheet detecting sensors such as the sheet detecting sensors 433, 435, 436, the control section 203 (FIG. 1) of the multi-stage feed apparatus 200 determines whether or not a sheet is jammed in the conveyance path. Then, in the case where the control section 203 determines that the sheet is jammed, the section 203 halts conveyance of the sheet, and displays the jam of the sheet and a portion of the jam on a display section such as a liquid crystal panel provided in the image forming system 1000. At this point, the section urges an operator such as a user and service person to open a door of the corresponding portion.

Further, in the case of this Embodiment, as shown in FIG. 3, with respect to the sheet width direction Y, opposed members 450, 460 opposed to the backside of the sheet conveyed by the conveyance belt 12 are disposed between the conveyance belt 12 and the pair of regulation guides 14A, 14B. In the case where an end portion of a sheet is conveyed, without being supported by any of the regulation guides 14A, 14B, the opposed members 450, 460 support the end portion of the sheet.

The relay conveying apparatus 400 thus configured nips the sheet delivered from the conveyance roller pair 401 upstream in the conveyance direction X to the conveyance belt 12 with the conveyance belt 12 and the sphere 20. Then, the sheet is conveyed by rotation of the conveyance belt 12. At this point, although details will be described later, the apparatus causes the opposite ends in the width direction Y of the sheet conveyed by the conveyance belt 12 to strike the guide faces 15A of the pair of regulation guides 14A, 14B. When the sheet is struck by the guide faces 15A, the sheet is conveyed in a direction parallel with the guide faces 15A, while causing the opposite side ends to move along the guide faces 15A and slipping between the conveyance belt 12 and the face. At this point, the sheet is nipped by the conveyance belt 12 and the sphere 20, and since the sphere 20 is rotatable in any direction, is capable of shifting, while slipping on the conveyance belt 12 in any direction. By this means, the side registration and side skew of the sheet is corrected.

[Regulation Guide]

Next, descriptions will be given to the detailed configuration of the regulation guides 14A, 14B as the first regulation guide and the second regulation guide, with reference to FIGS. 6A to 6D. In addition, although FIGS. 6A to 6D illustrate only the regulation guide 14A on one side, the regulation guide 14B on the other side also has the same configuration. As shown in FIG. 5, the regulation guide 14A includes the side plate portion 15 having the guide face 15A, the lower plate portion 16 having the support face 16A, and the upper plate portion 17 having the opposed face 17A.

Figure 6A:
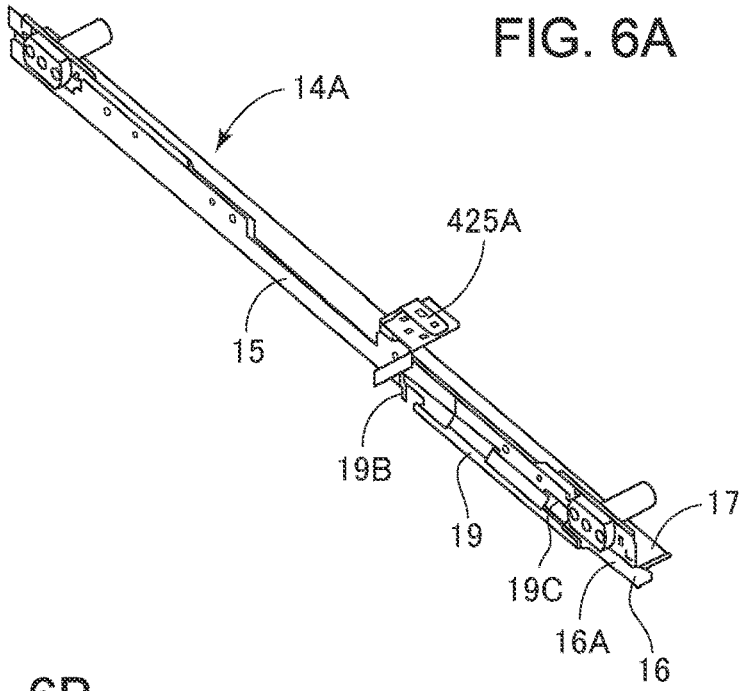
FIG. 6A is a perspective view of a regulation guide according to Embodiment 1.
Figure 6B:
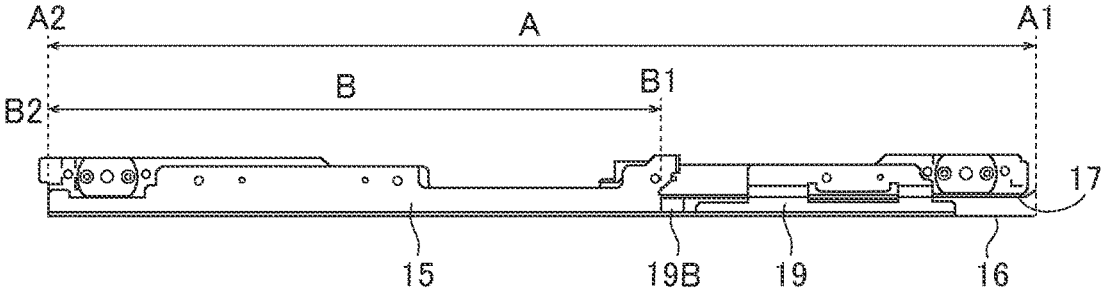
FIG. 6B is a view of the guide looking from the left side in FIG. 6A.

As shown in FIGS. 6A and 6B, the lower plate portion 16 and upper plate portion 17 are provided continuously over almost the entire area in the longitudinal direction of the regulation guide 14A. As shown in FIG. 2 and so on, since the regulation guide 14A is disposed substantially parallel with the conveyance direction X, a predetermined region A refers to a range where the lower plate portion 16 and upper plate portion 17 are continuous with respect to the conveyance direction X. Accordingly, in this Embodiment, the support face 16A of the lower plate portion 16 and the opposed face 17A of the upper plate portion 17 are provided continuously over the predetermined region A with respect to the conveyance direction X. The predetermined region A is almost the entire area of the region where the sheet is conveyed by the misregistration correcting section 410.

Figure 6C:
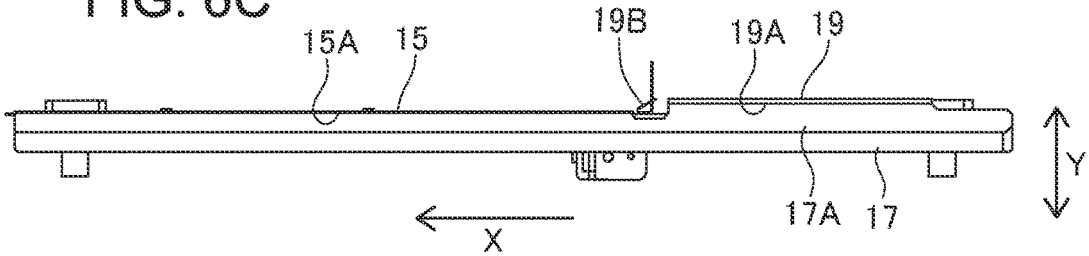
FIG. 6C is a cross-sectional view of the guide taken in a direction along a conveyance direction of a sheet.
Figure 6D:
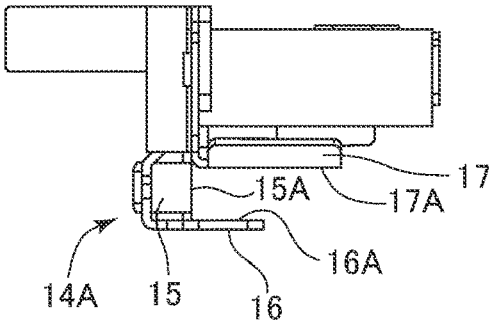
FIG. 6D is a cross-sectional view of the guide taken in a direction orthogonal to the conveyance direction of the sheet.

On the other hand, as shown in FIGS. 6A to 6C, the side plate portion 15 is provided continuously over a guide region B that is a region shorter than the predetermined region A. In this Embodiment, an upstream end (upstream end in the conveyance direction) B1 of the side plate portion 15 in the conveyance direction X is positioned on the downstream side from an upstream end A1 of the predetermined region A in the conveyance direction X. In other words, the upstream end B1 of the guide face 15A of the side plate portion 15 in the conveyance direction X is positioned on the downstream side from the upstream end A1 of the predetermined region A. Further, with respect to the conveyance direction X, the guide face 15A is provided continuously up to a downstream end A2 of the predetermined region A. Accordingly, a position of a downstream end B2 of the side plate portion 15 in the conveyance direction X and a position of the downstream end A2 of the predetermined region A in the conveyance direction X are almost the same position with respect to the conveyance direction X.

In this Embodiment, a notch 19C is provided on the upstream side from the upstream end B1 of the side plate portion 15. Then, in a part of the notch 19C is disposed an outer plate portion 19 positioned on the outer side of the side plate portion 15 in the sheet width direction Y. The outer side in the sheet width direction Y is a side spaced apart from the conveyance belt 12 with respect to the sheet width direction Y. Therefore, as shown in FIG. 6C, an inner face 19A of the outer plate portion 19 is positioned on the outer side in the sheet width direction Y than the guide face 15A that is the inner face of the side plate portion 15. Further, with respect to the conveyance direction X, between the outer plate portion 19 and the side plate portion 15 is provided an inclined plate portion 19B inclined closer to the side plate portion 15, as going downstream.

Each of the pair of regulation guides 14A, 14B is configured as described above, and a distance in the width direction Y between the inner faces 19A of the outer plate portions 19 on the upstream side in the conveyance direction X is thereby wider than a distance in the width direction Y between the guide faces 15A of the side plate portions 15. Therefore, as described later in detail, the opposite end edges in the width direction Y of the sheet delivered from the conveyance roller pair 401 on the upstream side to the conveyance belt 12 are positioned between the inner faces 19A on the upstream side in the conveyance direction X, and by conveying to the downstream side, are positioned between the guide faces 15A.

In addition, the outer plate portion 19 and inclined plate portion 19B may be omitted. However, in the case where the end portion in the width direction Y of the sheet delivered from the conveyance roller pair 401 on the upstream side to the conveyance belt 12 is positioned inside the notch 19C, when the sheet is further conveyed, there is the risk that the end portion of the sheet is caught in the upstream end B1 of the side plate portion 15. Therefore, in this Embodiment, the outer plate portion 19 and inclined plate portion 19B are provided, and it is configured that also in the case where the sheet is conveyed, while being displaced from a normal position in the width direction Y, the outer plate portion 19 regulates a position of the sheet, and that the inclined plate portion 19B further guides the end portion of the sheet to the guide face 15A of the side plate portion 15.

[Contact-Separation Configuration of the Conveyance Roller Pair]

Figure 7:
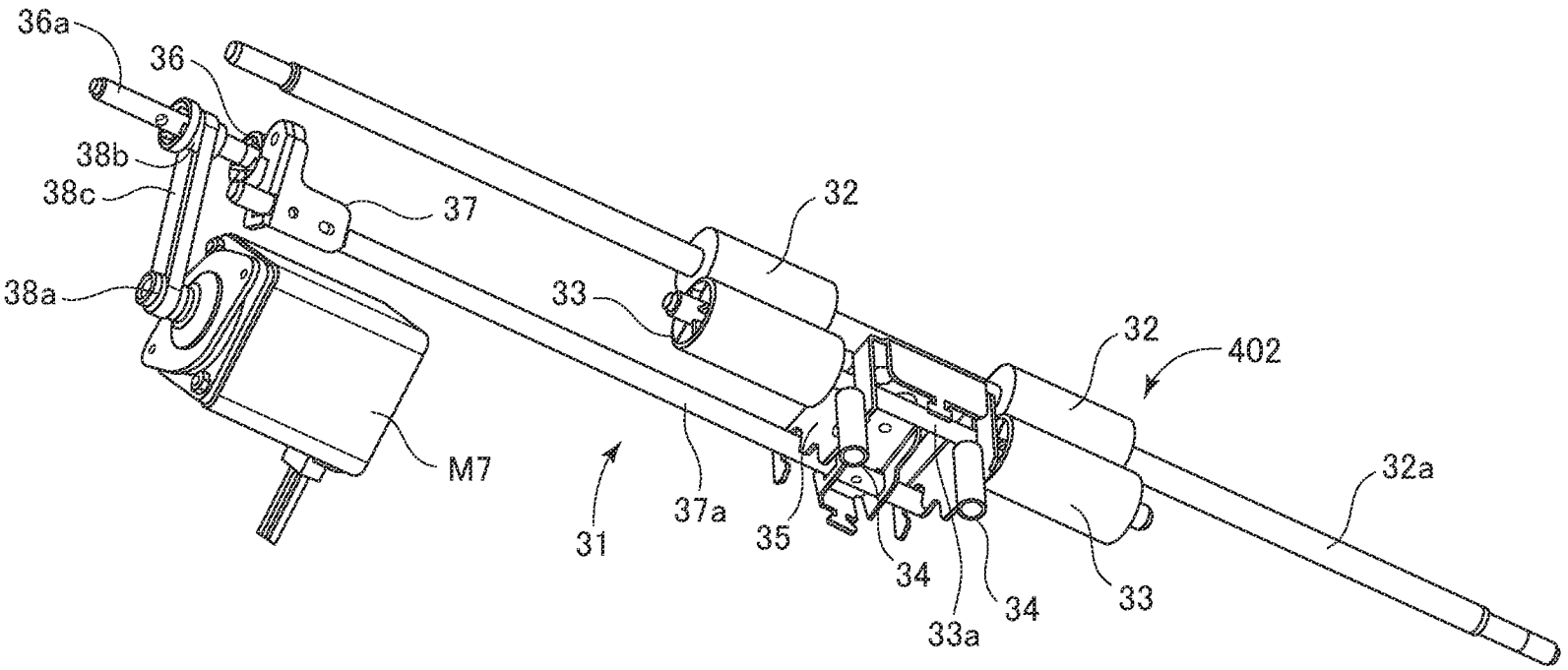
FIG. 7 is a perspective view illustrating a contact-separation mechanism of conveyance rollers according to Embodiment 1.

Next, referring to FIGS. 1 and 2, the contact-separation configuration of the conveyance roller pairs 401 to 403 will be described using FIGS. 7, 8A and 8B. As described above, each of the conveyance roller pairs 401 to 403 is disposed upstream or downstream of the conveyance belt 12 in the conveyance direction X. Each of the conveyance roller pairs 401 to 403 has a drive roller 32 and driven roller 33 as a pair of conveyance rollers. The drive roller 32 is an elastic roller where an elastic body such as rubber is provided around a rotation shaft 32*a*. The driven roller 33 comes into contact with the drive roller 32 to form the nip portion for nipping the sheet to convey. The drive roller 32 of the conveyance roller pair 401, the drive roller 32 of the conveyance roller pair 402, and the drive roller 32 of the conveyance roller pair 403 are capable of being driven to rotate independently of one another, by a motor M4, motor M5 and motor M6, respectively.

In this Embodiment, the conveyance roller pairs 402, 403 disposed on the downstream side (downstream side in the conveyance direction) of the conveyance belt 12 in the conveyance direction X have the configuration for enabling the drive roller 32 and driven roller 33 to come into contact and separate with/from each other. By a motor M7 and motor M8, the conveyance roller pairs 402, 403 enable the drive roller 32 and driven roller 33 to come into contact and separate with/from each other independently, respectively. Since configurations of the conveyance roller pairs 402, 403 are the same, the contact-separation configuration will be described below using the conveyance roller pair 402 as an example, with reference to FIGS. 7, 8A and 8B.

A contact-separation mechanism 31 for causing the drive roller 32 and driven roller 33 to come into contact and separate with/from each other has a compression spring 34 as a biasing member, support member 35, motor M7, separation cam 36 and link member 37. The contact-separation mechanism 31 corresponds to a roller shift section for enabling at least one of the pair of conveyance rollers i.e. the driven roller 33 to shift to a nip position for enabling a sheet to be nipped and conveyed, and a nip release position where the pair of conveyance rollers are separate from the nip position.

The compression spring 34 is a spring for biasing the driven roller 33 toward the drive roller 32. The support member 35 supports a rotation shaft 33*a* of the driven roller 33, and is supported swingably around a swing shaft 37*a* as the center. Further, the support member 35 is biased by the compression spring 34 in a direction for pressing the driven roller 33 to the drive roller 32 with the swing shaft 37*a* as the center. The support member 35 is fixed to the swing shaft 37*a*, rotates together with the swing shaft 37*a*, and shifts the driven roller 33 in a direction for approaching the drive roller 32 and in a direction for separating from the drive roller 32.

The motor M7 drives the separation cam 36 to rotate via pulleys 38*a*, 38*b*, and a belt 38*c*. The pulley 38*a* is fixed to a drive shaft of the motor M7, and the pulley 38*b* is fixed to a rotation shaft 36*a* of the separation cam 36. The belt 38*c* is an endless belt looped between the pulleys 38*a*, 38*b*. The separation cam 36 is an eccentric cam that the center of the outer circumferential surface is eccentric from the center of the rotation shaft 36*a*, and rotates together with the rotation shaft 36*a* by drive of the motor M7.

The link member 37 is fixed to the swing shaft 37*a*, and is provided swingably together with the swing shaft 37*a*. Accordingly, the link member 37 rotates in synchronization with the support member 35 via the swing shaft 37*a*. The link member 37 is disposed to come into contact with the separation cam 36, by the support member 35 being biased by the compression spring 34.

Figure 8A:
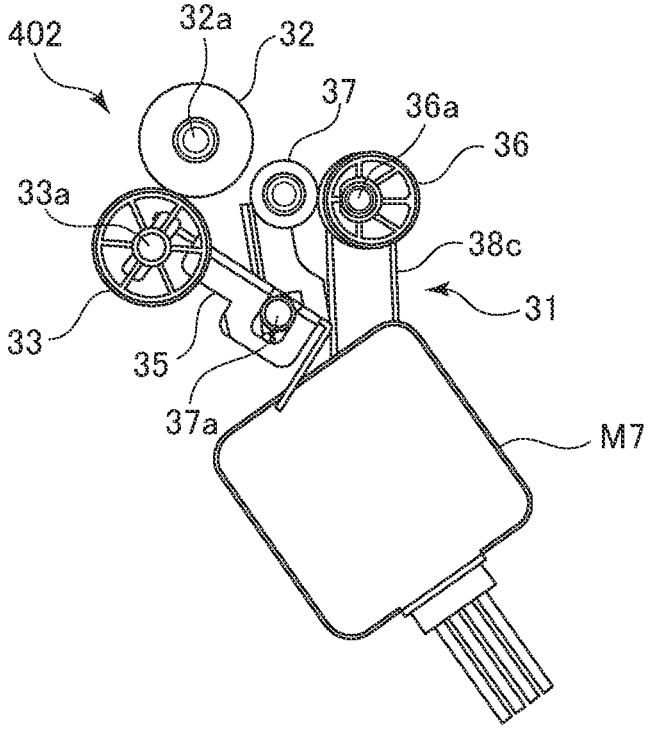
FIG. 8A is a side elevational view illustrating a nip state of the conveyance rollers of the contact-separation mechanism of conveyance rollers according to Embodiment 1.

In the case where the separation cam 36 is in a phase shown in FIG. 8A, the driven roller 33 is brought into press-contact with the drive roller 32 by the biasing force of the compression spring 34. The state of FIG. 8A is the nip position. From this state, for example, when the separation cam 36 is driven to rotate 180° by the motor M7, as shown in FIG. 8B, the link member 37 is pressed by the separation cam 36 to swing around the swing shaft 37*a* as the center in a counterclockwise direction in the figure. Then, the support member 35 coupled to the link member 37 via the swing shaft 37*a* swings around the swing shaft 37*a* as the center in the same direction. The driven roller 33 is supported by the support member 35 via the rotation shaft 33*a*, and therefore, by the swing of the support member 35, separates from the drive roller 32. In other words, the driven roller 33 is shifted to the nip release position.

Figure 8B:
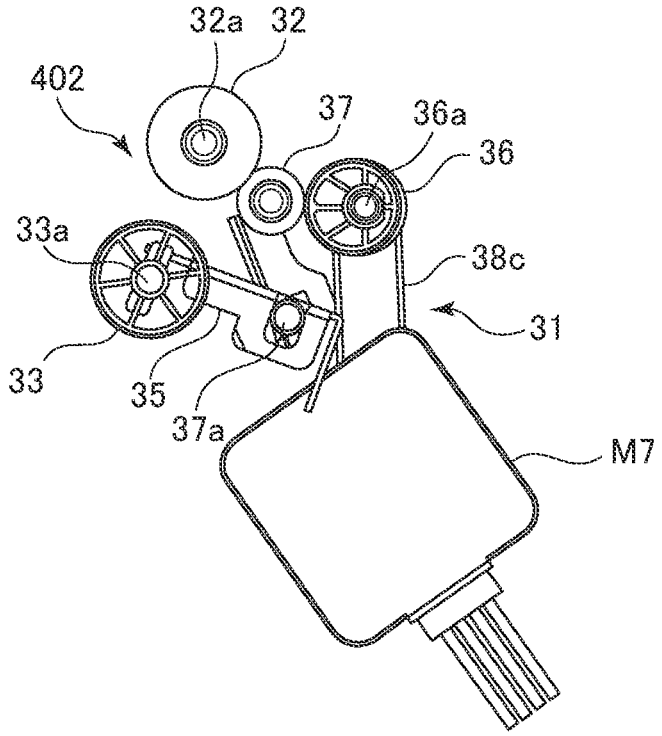
FIG. 8B is a side elevational view illustrating a nip release state of the conveyance rollers.

In the case of shifting the driven roller 33 from the nip release position to the nip position, the separation cam 36 is further rotated 180° from the state of FIG. 8B by the motor M7. In addition, the contact-separation mechanism for causing the drive roller 32 and driven roller 33 to come into contact and separate with/from each other may be a configuration for shifting both the drive roller 32 and the driven roller 33. Further, in the above-mentioned example, the contact-separation mechanism is driven by the motor, and contact and separation of a pair of conveyance rollers may be performed by another drive source such as a solenoid.

Further, in the above-mentioned example, the conveyance roller pairs 402, 403 on the downstream side of the conveyance belt 12 in the conveyance direction X are allowed to come into contact and separate, and only the conveyance roller pair 402 may be allowed to come into contact and separate. Further, the conveyance roller pair 401 on the upstream side of the conveyance belt 12 in the conveyance direction X may be allowed to come into contact and separate. In this case, only the conveyance roller pair 401 on the upstream side may be allowed to come into contact and separate, and also the conveyance roller pair 402 on the downstream side and further, also the conveyance roller pair 403 may be allowed to come into contact and separate.

[Sheet Conveyance Operation]

Figure 9:
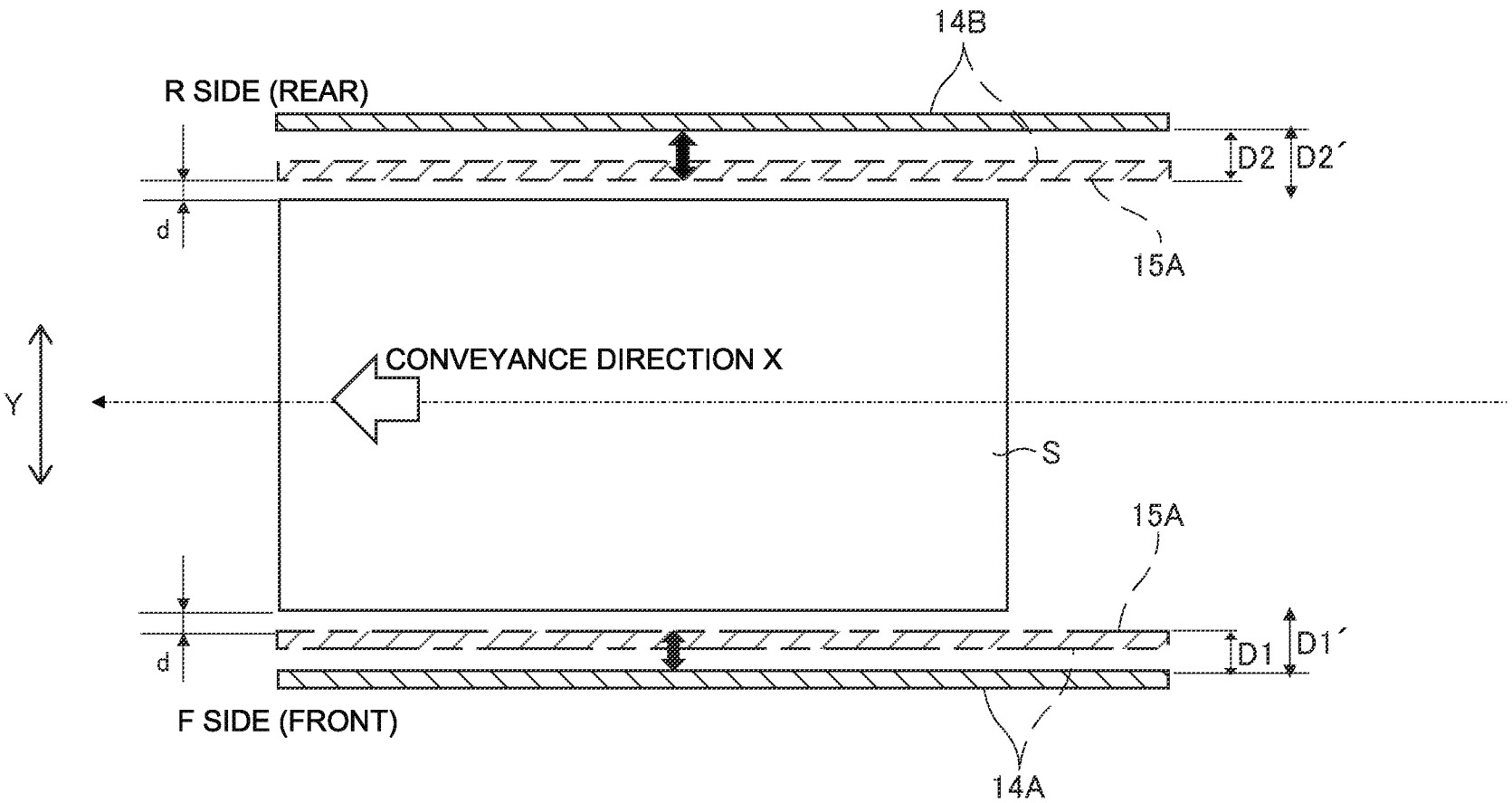
FIG. 9 is a view to explain operation of regulation guides according to Embodiment 1.

Next, sheet conveyance operation in the relay conveying apparatus 400 in this Embodiment will be described using FIG. 9, while referring to FIGS. 2 and 3, etc. In this Embodiment, the control section 203 (FIG. 1) controls the motors M2, M3 (FIG. 2) corresponding to a conveyance state of the sheet, and changes positions of the pair of regulation guides 14A, 14B in the sheet width direction Y. As described above, by controlling the motors M2, M3, the guide shift section 420 (FIG. 2) is driven to enable the pair of regulation guides 14A, 14B to shift to the guide positions and the retract positions. In FIG. 9, the pair of regulation guides 14A, 14B in the retract positions are shown by the solid lines, and the pair of regulation guides 14A, 14B in the guide positions are shown by the dashed lines.

Herein, as shown by the dashed lines in FIG. 9, the guide positions are positions for enabling the guide faces 15A of the pair of regulation guides 14A, 14B to guide the end edges in the width direction Y of the sheet that is conveyed by the conveyance belt 12 and the sphere 20, while being nipped. In this Embodiment, the guide positions are positions where a distance between the guide faces 15A (between the guide faces) of the pair of regulation guides 14A, 14B is longer than a length in the sheet width direction Y of the sheet that is conveyed by the conveyance belt 12 and the sphere 20, while being nipped.

Specifically, in a state in which a center position of the sheet in the width direction Y coincides with a center position between the guide faces 15A on the opposite sides and in a state in which the end edges of the sheet in the width direction Y are parallel with the guide faces 15A (center reference), when the sheet is conveyed, the guide positions are positions where a predetermined distance d is made between the end edge of the sheet in the width direction Y and the guide face 15A. The predetermined distance d is capable of being set as appropriate according to the apparatus, and is a distance capable of permitting displacement between the sheet and an image formed on the sheet when the sheet is displaced within the distance. For example, the predetermined distance is 0.5 mm. In other words, in the guide positions, the guide faces 15A of the pair of regulation guides 14A, 14B are in positions spaced 0.5 mm apart from the end edges of the sheet in the width direction Y, respectively. The control section 203 is capable of modifying the guide position as appropriate corresponding to the sheet size.

Thus, in the guide positions, since the pair of regulation guides 14A, 14B are positioned in the positions where the distance between the guide faces 15A of the pair of regulation guides 14A, 14B is longer than the length of the sheet in the sheet width direction Y, it is possible to suppress a conveyance load of the sheet conveyed by the conveyance belt 12. For example, in the case where the distance between the guide faces is the same as the length of the sheet in the width direction Y, the sheet is conveyed with the end portions of the sheet rubbing against the guide faces, and conveyance resistance is increased. Particularly, in this Embodiment, since the sheet is nipped and conveyed by the conveyance belt 12 and the sphere 20, the nip pressure for nipping the sheet by the conveyance belt 12 and the sphere 20 is low. Therefore, when the conveyance resistance of the sheet is high, there is the risk that a conveyance failure tends to occur such that a delay occurs in conveyance of the sheet, and that conveyance of the sheet is halted. Therefore, in this Embodiment, by positioning the pair of regulation guides 14A, 14B in the guide positions as described above, it is configured to suppress the conveyance resistance of the sheet.

In addition, it is preferable to correct (perform alignment operation) the side registration and side skew of the sheet as described later, by conveying the sheet with the center reference as described above. This is because in this Embodiment, correction of the side skew is made, by slipping the sheet between the conveyance belt 12 and the sphere 20 and rotating the sheet. In other words, by starting the alignment operation in the position (center reference) where the center of gravity of the sheet S substantially coincides with the center portion of the regulation guides 14A, 14B, it is possible to reduce damage to the sheet in the alignment operation.

On the other hand, as shown by the solid lines in FIG. 9, the retract positions are positions where the guide faces 15A of the pair of regulation guides 14A, 14B are retracted from the end edges of the sheet in the width direction Y more than the guide positions. In other words, the distance in the width direction Y between the guide faces 15A of the pair of regulation guides 14A, 14B in the retract positions is wider than the distance in the width direction Y between the guide faces 15A of the pair of regulation guides 14A, 14B in the guide positions.

In this Embodiment, as shown in FIG. 9, a distance D1 from the retract position to the guide position of the regulation guide 14A on the front side (F side (Front)) is shorter than a distance D2 from the retract position to the guide position of the regulation guide 14B on the rear side (R side (Rear)). In the example shown in the figure, with respect to the regulation guide 14A on the front side, the retract position is a position where a distance D1' between the end edge in the width direction Y of the sheet conveyed in the above-mentioned center reference and the guide face 15A is 4.5 mm. On the other hand, with respect to the regulation guide 14B on the rear side, the retract position is a position where a distance D2' between the end edge in the width direction Y of the sheet conveyed in the above-mentioned center reference and the guide face 15A is 5.0 mm.

As described above, the distance d between each of the pair of the regulation guides 14A, 14B in the guide position and the end edge of the sheet in the width direction Y is 0.5 mm. Accordingly, a distance D1 on the front side is 4.0 mm, and a distance D2 on the rear side is 4.5 mm. In other words, a shift amount from the retract position to the guide position of the regulation guide 14A on the front side is 4.0 mm, a shift amount from the retract position to the guide position of the regulation guide 14B on the rear side is 4.5 mm, and the shift amount of the regulation guide 14A on the front side is smaller than the shift amount of the regulation guide 14B on the rear side.

In this Embodiment, when the sheet is delivered from the conveyance roller pair 401 as the conveyance section to the conveyance belt 12, after at least a front end of the sheet is delivered to the conveyance belt 12, and the sheet loses contact with the conveyance roller pair 401, the guide shift section 420 causes the pair of regulation guides 14A, 14B to arrive at the guide positions. Specifically, in a state in which the regulation guides 14A, 14B are in the retract positions, the sheet S is delivered from the conveyance roller pair 401 to the conveyance belt 12. In other words, in a state in which the sheet S is conveyed by the conveyance roller pair 401, the front end of the sheet S arrives at the conveyance belt 12. In this state, a shift of the sheet S in the vertical direction is regulated by the support faces 16A and opposed faces 17A. By this means, even in the case where the sheet S is curled, when the regulation guides 14A, 14B shift from the retract positions to the guide positions, it is possible to accommodate the opposite end edges of the sheet S within the region surrounded by the guide faces 15A, support faces 16 and opposed faces 17A.

Thus, in this Embodiment, in the case where the sheet S is conveyed from the conveyance roller pair 401 on the upstream side to the conveyance belt 12, the pair of regulation guides 14A, 14B are shifted to the retract positions. This is because in delivering the sheet S to the conveyance belt 12, in the case where the pair of regulation guides 14A, 14B are in the guide positions, when the sheet S is skewed and/or is displaced in the width direction Y, the end portion of the sheet S interferes with one of the regulation guides 14A, 14B, and there is the risk that a conveyance failure of the sheet S occurs.

Next, after a rear end (upstream end) of the sheet S delivered from the conveyance roller pair 401 to the conveyance belt 12 passes through the conveyance roller pair 401, the control section 203 shifts the pair of regulation guides 14A, 14B from the retract positions to the guide positions. In other words, after the sheet S loses contact with the conveyance roller pair 401, the pair of regulation guides 14A, 14B are configured to arrive at the guide positions. In addition, in the case of the configuration for enabling the conveyance roller pair 401 on the upstream side to contact and separate, after the front end of the sheet S is delivered to the conveyance belt 12, the conveyance roller pair 401 may be separated before the rear end of the sheet S passes through the conveyance roller pair 401. In other words, the contact-separation mechanism (conveyance roller pair shift section) 31 described in the above-mentioned FIGS. 7, 8A and 8B is also applicable to the conveyance roller pair 401. The contact-separation mechanism 31 does not only contact and separate the conveyance roller pair, but also is capable of shifting the conveyance roller pair to the nip position for applying the conveyance force to the sheet, and the nip release position where the nip pressure is weaker than in the nip position. Accordingly, after the front end of the sheet S is delivered to the conveyance belt 12, before the rear end of the sheet S passes through the conveyance roller pair 401, the conveyance roller pair 401 may be shifted to the nip release position with the weaker nip pressure.

In this case, after the conveyance roller pair 401 is separated by the contact-separation mechanism 31 (after shifting from the nip position to the nip release position), the pair of regulation guides 14A, 14B are configured to arrive at the guide positions. In addition, the nip release position is not only a state in which separation is completely finished as described above, and for example, also is a state in which the nip pressure is weak to the extent that the regulation by the regulation guides 14A, 14B does not affect, and all of states where the conveyance roller pair is separated more than in this state correspond to the nip release position. In other words, the nip release position corresponds to the state where the conveyance roller pair is separated, and the state where the conveyance roller pair is mutually brought into contact but the nip pressure is lower than in conveying the sheet. Anyway, in this Embodiment, in the state in which the sheet S delivered to the conveyance belt 12 exists within the predetermined region A (FIG. 6B, within the predetermined region), the pair of regulation guides 14A, 14B are shifted from the retract positions to the guide positions. By this means, corrections (alignment operation) of the side registration and side skew of the sheet S are made.

In other words, in the case where the sheet S exists on the upstream side in the conveyance direction X, the regulation guides 14A, 14B are positioned in the retract positions, and the opposite end edges of the sheet S are separated from the guide faces 15A. Then, after the sheet S is further conveyed to the downstream side, and the rear end of the sheet S passes through the conveyance roller pair 401, the regulation guides 14A, 14B shift to the guide positions. Then, the opposite end edges of the sheet S in the width direction Y are brought into contact with the guide faces 15A. When the sheet S is struck by the guide faces 15A, while the end edges travel along the guide faces 15A, the sheet S slips between the conveyance belt 12 and the faces, and is conveyed in the direction parallel with the guide faces 15A. By this means, the side registration and side skew of the sheet S is corrected.

In this Embodiment, for a period during which the sheet is nipped and conveyed by the conveyance belt 12 and the sphere 20, the control section 203 shifts the pair of regulation guides 14A, 14B from the retract positions to the guide positions. By this means, without halting conveyance of the sheet, it is possible to make corrections of side registration, side skew and the like of the sheet, and it is possible to enhance productivity. In addition, after halting conveyance of the sheet once, the pair of regulation guides 14A, 14B may be shifted from the retract positions to the guide positions to perform alignment operation. In this case, although productivity is decreased, it is possible to make corrections of misregistration and the like with more reliability.

Thus, in the case of this Embodiment, after the rear end of the sheet delivered to the conveyance belt 12 passes through the conveyance roller pair 401 on the upstream end (i.e. after the sheet S loses contact with the conveyance roller pair 401), the pair of regulation guides 14A, 14B are shifted from the retract positions to the guide positions. Therefore, in delivering the sheet to the conveyance belt 12, it is possible to make the pair of regulation guides 14A, 14B hard to interfere with the sheet. Further, for a period during which the sheet is conveyed by the conveyance roller pair 401 on the upstream side, since the pair of regulation guides 14A, 14B are not positioned in the guide positions, it is possible to prevent the sheet under conveyance by the conveyance roller pair 401 from coming into contact with one of the regulation guides and thereby being bent.

Further, since the pair of regulation guides 14A, 14B are shifted to the guide positions after the rear end of the sheet passes through the conveyance roller pair 401, for example, without conveying the sheet obliquely to strike the regulation guide, it is possible to make corrections of misregistration and the like of the sheet. Therefore, without increasing the length to convey the sheet, it is made possible to make corrections of misregistration and the like of the sheet, and it is possible to suppress increases in size of the apparatus. In other words, while suppressing increases in size of the apparatus, it is possible to correct the misregistration of the sheet in the width direction Y.

Herein, in the case where the pair of regulation guides 14A, 14B arrive at the guide positions at the same time, by vibrations of the pair of regulation guides 14A, 14B, there is the risk that conveyance of the sheet S is affected. In other words, when the regulation guides 14A, 14B shift from the retract positions and halt in the guide positions, the guides vibrate. For example, by the vibration when each of the guides shifts and halts, there is the risk of a warp of 1 mm at the maximum. Accordingly, in the case where the regulation guides 14A, 14B arrive at the guide positions at the same time, there is the risk that each of the guides warps toward the sheet side (inward) by 1 mm at the same time. As described above, in the guide positions, the distance between each of the regulation guides 14A, 14B and the end edge of the sheet in the width direction Y is 0.5 mm. Therefore, in the guide positions, the distance of 0.5 mm exists on each of the opposite sides of the sheet in the width direction, and there is a margin of total 1 mm between the sheet and the regulation guides.

In addition, when the pair of regulation guides 14A, 14B are concurrently warped inward each by 1 mm, the total warp of 2 mm is made, and the distance between the regulation guides 14A, 14B is 1 mm short with respect to the margin of 1 mm in the above-mentioned guide positions. Therefore, in the case where the regulation guides 14A, 14B arrive at the guide positions at the same time, there is a possibility that the regulation guides 14A, 14B press in the sheet. Therefore, this Embodiment is to displace timings at which the pair of regulation guides 14A, 14B arrive at the guide positions.

In other words, in shifting the pair of regulation guides 14A, 14B from the retract positions to the guide positions, after the regulation guide (first regulation guide) 14A on the front side arrives at the guide position, the guide shift section 420 causes the regulation guide (second regulation guide) 14B on the rear side to arrive at the guide position. Therefore, in this Embodiment, as described above, the distance D1 from the retract position to the guide position of the regulation guide 14A on the front side is shorter than the distance D2 from the retract position to the guide position of the regulation guide 14B on the rear side.

Further, in the case of this Embodiment, shift velocities of the regulation guides 14A, 14B are the same as each other. For example, it is assumed that each of the shift velocities is 700 mm/s. Furthermore, shift start timings are also the same in shifting the regulation guides 14A, 14B from the retract positions to the guide positions. By thus configuring, the regulation guide 14A arrives at the guide position earlier than the regulation guide 14B. In other words, it is possible to displace the timings at which the pair of regulation guides 14A, 14B arrive at the guide positions. Thus, in this Embodiment, since the timings at which the pair of regulation guides 14A, 14B arrive at the guide positions are varied, it is possible to suppress concurrent occurrences of vibration due to the shift halt, and it is possible to suppress that the regulation guides 14A, 14B press in the end edges of the sheet in the width direction Y. As a result, it is possible to stably perform conveyance of the sheet.

In addition, the shift velocities of the regulation guides 14A, 14B may not be the same, as long as the regulation guide 14A arrives at the guide position earlier than the regulation guide 14B. For example, the shift velocity of the regulation guide 14A may be made faster. Further, by setting a difference between the shift distances and timings for starting the shift as appropriate, the shift velocity of the regulation guide 14A may be made slower.

Further, shift start timings of the regulation guides 14A, 14B from the retract positions to the guide positions may also not be the same. For example, the shift start timing of the regulation guide 14A may be made earlier. Furthermore, by setting a difference between the shift distances and shift velocities as appropriate, the shift start timing of the regulation guide 14A may be made later. It is essential only that the regulation guide 14A first arrives at the guide position, by setting the shift distance, shift velocity and shift start timing of each of the guides as appropriate.

Embodiment 2

Referring to FIGS. 2, 3 and so on, Embodiment 2 will be described using FIG. 10. The above-mentioned Embodiment 1 describes the configuration where the distance D1 from the retract position to the guide position of the regulation guide 14A on the front side is shorter than the distance D2 from the retract position to the guide position of the regulation guide 14B on the rear side. In contrast thereto, in this Embodiment, the distances D1 and D2 are the same. Since the other configuration and action are the same as in the above-mentioned Embodiment 1, the same components are assigned the same reference numerals to omit or simplify descriptions of the detail and figure, and Embodiment 2 will be described below with emphasis placed on respects different from Embodiment 1.

Figure 10:
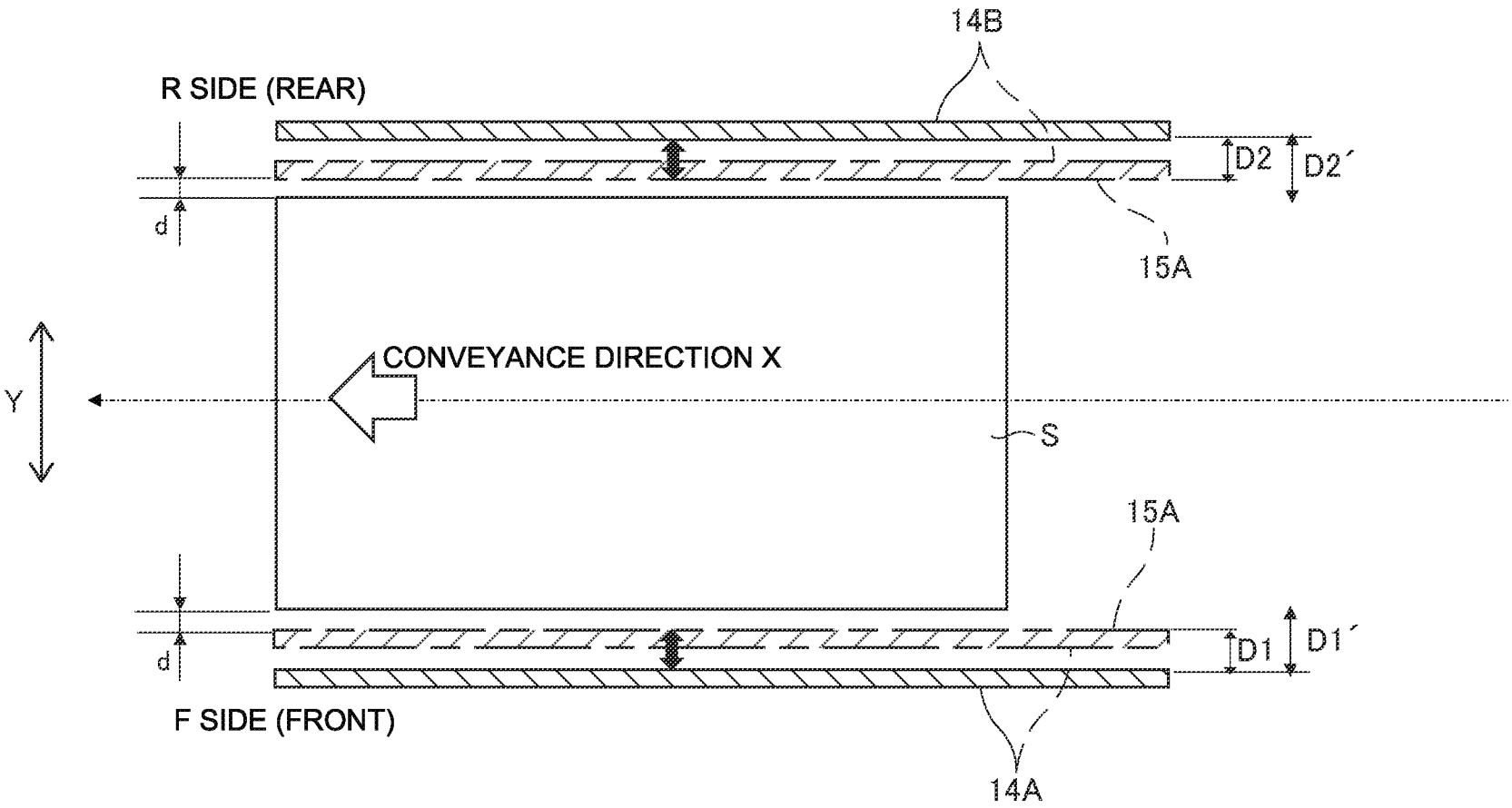
FIG. 10 is a view to explain operation of regulation guides according to Embodiment 2.

In this Embodiment, as shown in FIG. 10, the distance D1 from the retract position to the guide position of the regulation guide (first regulation guide) 14A on the front side is the same as the distance from the retract position to the guide position of the regulation guide (second regulation guide) 14B on the rear side. In addition, also in FIG. 10, the pair of regulation guides 14A, 14B in the retract positions are shown by the solid lines, and the pair of regulation guides 14A, 14B in the guide positions are shown by the dashed lines.

For example, the distances D1, D2 are the same, and are 4.5 mm, or 4.0 mm. The distance d is 0.5 mm between each of the pair of regulation guides 14A, 14B in the guide positions and the end edge of the sheet in the width direction Y. Accordingly, a distance D1' between the regulation guide 14A on the front side and the end edge of the sheet S in the width direction Y is the same as a distance D2' between the regulation guide 14B on the rear side and the end edge of the sheet S in the width direction Y.

In the case of such an Embodiment, in order for the regulation guide 14A to arrive at the guide position earlier than the regulation guide 14B, a shift velocity V1 of the regulation guide 14A from the retract position to the guide position is made faster than a shift velocity V2 of the regulation guide 14B from the retract position to the guide position. In other words, there is a difference between the shift velocities of the regulation guides 14A, 14B. For example, the shift velocity V1 of the regulation guide 14A is set at 1000 mm/s, and the shift velocity V2 of the regulation guide 14B is set at 700 mm/s.

In addition, the shift velocities V1, V2 may be made the same, and the shift start timings may be varied. In other words, in shifting the pair of regulation guides 14A, 14B from the retract positions to the guide positions, the shift start timing of the regulation guide (first regulation guide) 14A is made earlier than the shift start timing of the regulation guide (second regulation guide) 14B. For example, after the regulation guide 14A starts to shift from the retract position to the guide position, 300 ms later, the regulation guide 14B starts to shift from the retract position to the guide position. In addition, for example, each of the shift velocities V1, V2 at this point is set at 700 mm/s.

Also in the case of such an Embodiment, the regulation guide 14A is capable of arriving at the guide position earlier than the regulation guide 14B. Therefore, it is possible to suppress concurrent occurrences of vibration due to the shift halt, and it is possible to suppress that the regulation guides 14A, 14B press in the end edges of the sheet in the width direction Y. As a result, it is possible to stably perform conveyance of the sheet.

Another Embodiment

In each of the above-mentioned Embodiments, the control section 203 for controlling the relay conveying apparatus 400 is provided in the multi-stage feed apparatus 200, and the control section 140 of the image forming apparatus 100 may perform control by the section 203. Further, the relay conveying apparatus 400 may be provided with control sections for controlling respective sections of the relay conveying apparatus 400. Furthermore, the sheet conveying apparatus is not limited to the above-mentioned relay conveying apparatus, and may be another configuration which is a sheet conveying apparatus capable of correcting misregistration of the sheet.

Moreover, in each of the above-mentioned Embodiments, the regulation guide 14A on the front side is configured to arrive at the guide position earlier than the regulation guide 14B on the rear side, and the regulation guide 14B on the rear side may first arrive at the guide position. It is only essential to vary arrival timings of the pair of regulation guides 14A, 14B at the guide positions.

In addition, this application claims priority from Japanese Patent Application No. 2020-112401 incorporated herein by reference.

The invention claimed is:

1. A sheet conveying apparatus for receiving and conveying a sheet conveyed by a conveyance member for conveying the sheet in a predetermined conveyance direction, comprising:

an endless conveyance belt conveying the sheet conveyed by the conveyance member in the conveyance direction and having a conveyance face extended in the conveyance direction to convey the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a first regulation guide disposed on one side relative to the conveyance belt with respect to a sheet width direction crossing the conveyance direction to be able to guide an end edge on one side in the sheet width direction of the sheet conveyed by the conveyance belt and the spheres, while being nipped;

a second regulation guide disposed on another side relative to the conveyance belt with respect to the sheet width direction crossing the conveyance direction to be able to guide an end edge on another side in the sheet width direction of the sheet conveyed by the conveyance belt and the spheres, while being nipped; and a guide shift section to shift the first regulation guide and the second regulation guide to guide positions for guiding end edges of the sheet in the sheet width direction and retract positions retracted from the end edges of the sheet in the sheet width direction more than the guide positions, and wherein in shifting the first regulation guide and the second regulation guide from the retract positions to the guide positions, the guide shift section causes the second regulation guide to arrive at the guide position after a predetermined time since the first regulation guide arrived at the guide position, the conveyance member is a conveyance roller pair adapted to convey the sheet to the conveyance belt, the apparatus is further provided with a conveyance roller pair shift section adapted to shift the conveyance roller pair to a nip position for applying a conveyance force to the sheet and a nip release position where the conveyance roller pair is separated from the nip position, and when the sheet is delivered from the conveyance roller pair to the conveyance belt, after at least a front end of the sheet is delivered to the conveyance belt and the conveyance roller pair shifts from the nip position to the nip release position, the guide shift section causes the first regulation guide and the second regulation guide to arrive at the guide positions.

2. The sheet conveying apparatus according to claim 1, wherein when the sheet is delivered from the conveyance member to the conveyance belt, after at least a front end of the sheet is delivered to the conveyance belt and the sheet loses contact with the conveyance member, the guide shift section causes the first regulation guide and the second regulation guide to arrive at the guide positions.

3. A sheet conveying apparatus, comprising:

a conveyance belt conveying a sheet;

a plurality of spheres disposed in a conveyance direction of the sheet conveyed by the conveyance belt, the spheres rotating by contacting the sheet being conveyed by the conveyance belt and being provided at positions facing the conveyance belt through the sheet;

a conveyance roller pair disposed upstream with respect to the conveyance belt in the conveyance direction and conveying the sheet to the conveyance belt;

a first guide disposed to shift between a first retract position and a first guide position, the first guide position being a position closer to the conveyance belt than the first retract position in a width direction of the conveyance belt crossing the conveyance direction, and guiding one end on one side of the sheet in the width direction in a state the sheet being conveyed by the conveyance belt while contacting the spheres;

a second guide disposed on a side opposite to the first guide with respect to the conveyance belt in the width direction, the second guide being disposed to shift between a second retract position and a second guide position, the second guide position being a position closer to the conveyance belt than the second retract position in the width direction, and guiding another end on another side opposite to the one side of the sheet in the width direction in a state the sheet being conveyed by the conveyance belt while contacting the spheres;

a control unit configured to control movements of the first guide and the second guide such that the first guide moves from the first retract position toward the first guide position and the second guide moves from the second retract position toward the second guide position in a state that a front end of the sheet being conveyed by the conveyance belt is located in the sheet width direction between the first guide and the second guide, and the second guide arrives at the second guide position after a predetermined time since the first guide arrives at the first guide position in a state that a rear end of the sheet passes the conveyance roller pair;

a first motor driving the first guide; and a second motor driving the second guide, wherein the first motor and the second motor are arranged at a rear side in a front-rear direction of the sheet conveying apparatus relative to the first guide and the second guide, the first guide is arranged at a front side more than the second guide in the front-rear direction, and a distance from the first retract position of the first guide to the first guide position is shorter than a distance from the second retract position of the second guide to the second guide position.

4. The sheet conveying apparatus according to claim 3, wherein a shift velocity of the first guide from the first retract position to the first guide position is faster than a shift velocity of the second guide from the second retract position to the second guide position.

5. The sheet conveying apparatus according to claim 3, wherein in shifting the first guide from the first retract position to the first guide position and shifting the second guide from the second retract position to the second guide position, shift start timing of the first guide is earlier than shift start timing of the second guide.

6. The sheet conveying apparatus according to claim 3, wherein the plurality of spheres is arranged in a center area between the first and second regulation guides.

* * * * *